US005261563A

United States Patent [19]

Brimhall

[11] Patent Number: 5,261,563

[45] Date of Patent: Nov. 16, 1993

[54] MANUALLY OPERATED LABEL DISPENSER

[76] Inventor: Randall L. Brimhall, 537 E. 8045 South, Sandy, Utah 84070

[21] Appl. No.: 940,679

[22] Filed: Sep. 4, 1992

[51] Int. Cl.[5] ..... G07F 11/68

[52] U.S. Cl. ..... 221/73; 221/71

[58] Field of Search ..... 221/73, 70, 71; 156/DIG. 33

[56] References Cited

U.S. PATENT DOCUMENTS 4,111,333 9/1978 Norgaard ..... 221/73
5,065,896 11/1991 Jurgich ..... 221/73

FOREIGN PATENT DOCUMENTS 1003122 2/1957 Fed. Rep. of Germany .
418241 1/1992 Japan .
937042 9/1963 United Kingdom .

*Primary Examiner*—Robert P. Olszewski
*Assistant Examiner*—Dean A. Reichard
*Attorney, Agent, or Firm*—Terry M. Crellin

[57] ABSTRACT

A label dispenser is disclosed for peeling individual adhesive-backed labels from a continuous strip of release paper upon which the labels are stored. The dispenser comprises a frame having a guide edge extending between the opposite sides of the frame and positioned adjacent to a top of the label dispensing end of the frame. When a strip of release paper containing an adhesive-backed label thereon passes over the guide edge it makes an abrupt turn as it passes over the guide edge, and the label is peeled from the release paper. A drive mechanism is positioned below the guide edge and spaced inwardly within the frame from the guide edge. The drive mechanism pulls the strip of release paper over the guide edge. A manually operated mechanism is provided for advancing the drive mechanism to draw a sufficient length of the strip of release paper through the drive mechanism so that a single label is peeled from the strip of release paper for each individual manual operation of the mechanism for advancing the drive mechanism.

3 Claims, 2 Drawing Sheets

MANUALLY OPERATED LABEL DISPENSER

BACKGROUND OF THE INVENTION

1. Field of the Invention

The present invention relates to label dispensers of the type in which labels with pressure sensitive adhesive are stripped from a dispensing strip having a release surface engaged by the adhesive. More particular, the present invention relates to a dispenser that is relatively inexpensive, simple and has a manually operated mechanism for dispensing single labels from the dispensing strip each time the mechanism is manually operated. In addition, the present invention relates to such a dispenser wherein the label stripped from the dispensing strip is held free of the dispensing strip for easy access by the user of the dispenser for direct application to the article to which the label is to be applied.

2. State of the Art

Gummed labels are in common usage. The labels are generally arranged side by side along a length of release strip. The gummed labels can be removed from the release strip and then adhered to the item upon which they are placed. There is a need for a simple label dispenser in which the labels can be easily and rapidly stripped one at a time from the dispensing strip. One such dispenser is shown in U.S. Pat. No. 5,065,896. The dispenser disclosed in U.S. Pat. No. 5,065,896 is however a rather cumbersome apparatus in which the dispensing strip is advanced over a diagonal stripping edge, and the corner of a label is first stripped from the dispensing strip. One then grabs the corner of the label and holds the label as the remainder of the label is stripped from the dispensing strip. It would be highly advantageous to provide a simple, inexpensive, relatively compact dispenser that is operated by a lever or crank and which will dispense a single label for each manual movement of the lever or crank. It would further be advantageous to temporarily hold the stripped label in a position free of the dispensing strip for access by the user or for direct application to the article to which the label is to be applied.

BRIEF DESCRIPTION OF THE INVENTION

In accordance with the present invention, a simple, relatively compact, inexpensive dispenser is provided which has a lever or crank that is moved between a first position and a second position. As the crank moves, the elongate strip of release paper to which the labels are temporarily attached moves from a storage space located between opposite sides of the frame of the dispenser. The strip of release paper is drawn over a guide edge at the top of one of the ends of the frame. The strip of release paper makes an abrupt turn downwardly over the guide edge and is drawn over a drive mechanism positioned below the guide edge at the top of the end of the frame and slightly inward of the end of the frame. As the strip of release paper is pulled over the guide edge, the adhesive backed label is stripped from its temporary attachment to the strip of release paper and moves outwardly from the guide edge in a direction away from the frame of the dispenser.

The strip of release paper is drawn around the drive mechanism and is ejected from the dispenser near the bottom of the frame of the dispenser. The drive mechanism is preferably a pair of wheels that are spaced apart from each other and which have a plurality of projections extending radially from the perimeter of the wheels. The projections are adapted to engage the perforated openings in the sides of the strip of release paper. The action of the wheels is similar to the tractor units on computer printers that feed paper and forms having spaced openings along the edges of the paper and forms. Strips of release paper having labels contained thereon and having spaced openings along the opposite edges of the strips of paper are well known. The openings ar used to feed the strips of paper through well known tractor units on printers. For use with strips of release paper that do not have the spaced openings on the opposite sides thereof, the drive mechanism of the present invention can be a platen and roller as conventionally used in typewriters.

A manually operated mechanism is provided for advancing the drive mechanism, whether the drive mechanism is the tractor type wheels or the platen and roller, to draw a specified length of the strip of release paper around the drive mechanism. This in turn draws just sufficient length of the strip of release paper around the guide edge so that a single label will be stripped from the release paper for each manual operation of the mechanism for advancing the drive mechanism. Preferably, a lever is provided that is attached through a ratchet type connection to the drive mechanism. The lever can move back and forth between first and second positions, with spring biasing means being provided for biasing the lever toward its first position. As the lever is manually moved from its first to its second position, it rotates the drive mechanism to draw the strip of release paper around the drive mechanism. The lever moves back to its first position under the action of the spring biasing means when manual engagement of the lever is released. During its travel between its second position and its first position, the lever moves freely with respect to the drive mechanism without moving the drive mechanism itself.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

DETAILED DESCRIPTION OF THE ILLUSTRATED EMBODIMENTS

Figure 2:
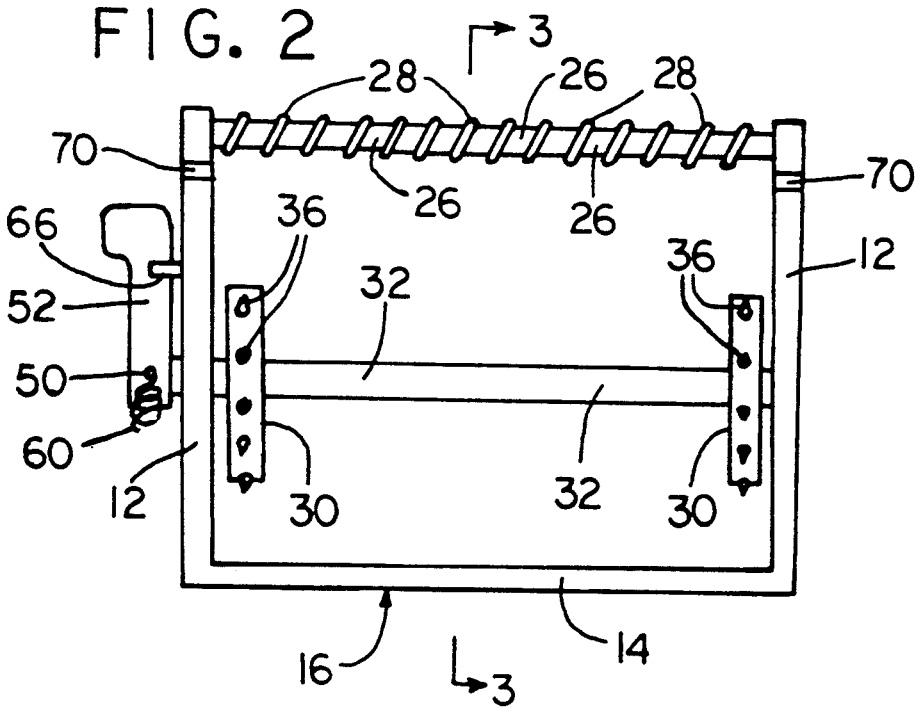
FIG. 2 is a front view of the label dispenser of FIG. 1.
Figure 3:
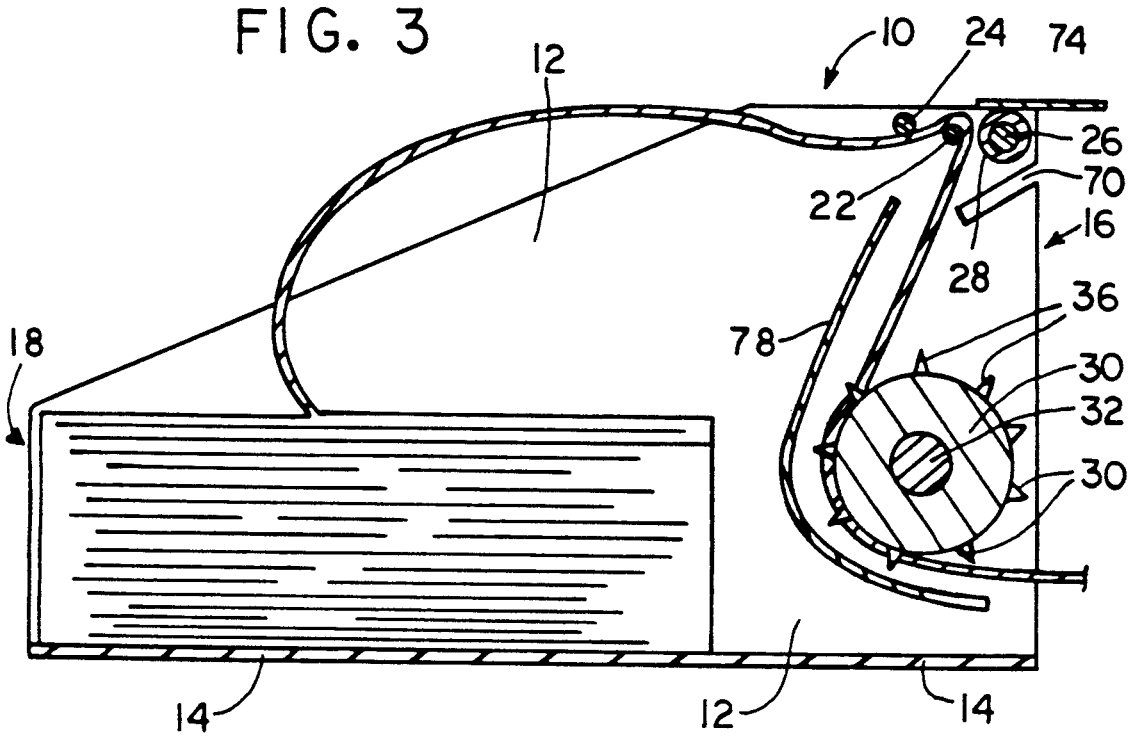
FIG. 3 is a vertical cross section taken along line 3—3 of FIG. 2.
Figure 4:
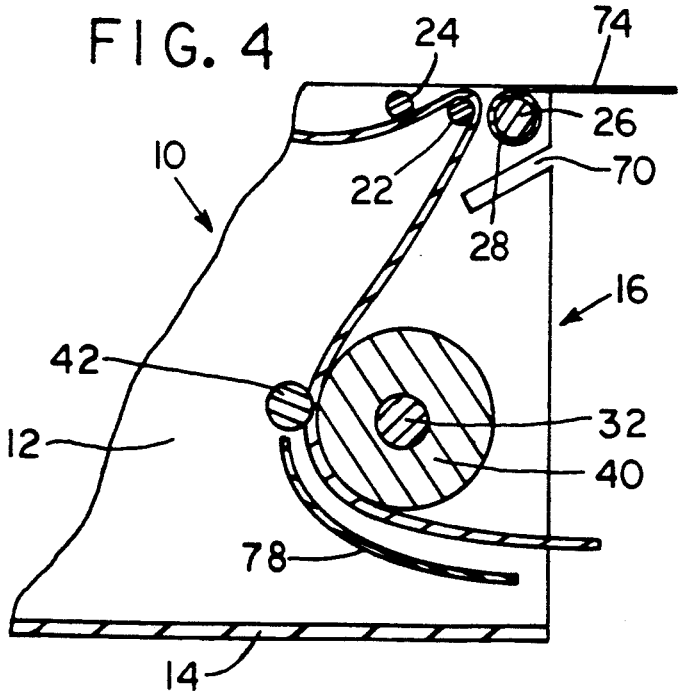
FIG. 4 is a partial vertical cross section similar to that of FIG. 3 but showing a platen and roller as the drive mechanism for pulling the strip of release paper through the dispenser.

As illustrated in the drawings, the dispenser of the present invention comprises a frame 10 having two opposite, elongated sides 12. A bottom floor member 14, as best shown in FIGS. 2–4 extends between the sides 12 adjacent to the lower edges of the sides 12. The bottom floor member 14 makes a convenient storage support to store a folded strip of labels as will be discussed further hereinafter.

The frame 10 has a front end 16 and a rear end 18. The dispensing mechanism as discussed further herein is located adjacent to the front end 16 which will also be referred to as the dispensing end. The rear end 18 is essentially open and is adapted to accept the storage of folded strips of labels. The front end 16 of the embodiment of the dispenser as illustrated in the drawings is generally rectangular in shape having a top edge, bottom edge and opposed side edges.

A guide edge 22 extends between the opposite sides 12 of the frame 10. The guide edge conveniently comprises a relatively small diameter rod 22 extending between the opposite sides 12 of the frame 10. The guide edge 22 is positioned adjacent to the top of the sides 12 of the frame 10 and the top of the label dispensing end 16 of the frame 10. The guide edge 22 is spaced back a short distance from the forward edge of the sides 12 which form the rectangular front of the dispensing end 16 of the frame 10. The set back is sufficient to allow a rod 26 having a somewhat larger diameter than the rod forming the guide edge 22 to be positioned between the guide edge 22 and the forward edges of the sides 12 that form the rectangular front of the dispensing end 16 of the frame 10.

The rod 26 extends between the opposite sides 12 of the frame 10 and is positioned substantially parallel with the guide edge 22. The rod 26 abuts closely the top edge of the dispensing end 16 of the frame 10 of the dispenser. A coil spring 28 or coiled wire member is positioned around the rod 26 such that the coil spring 28 is coaxial with the rod 26. The coil spring 28 freely rotates about the rod 26.

Figure 1:
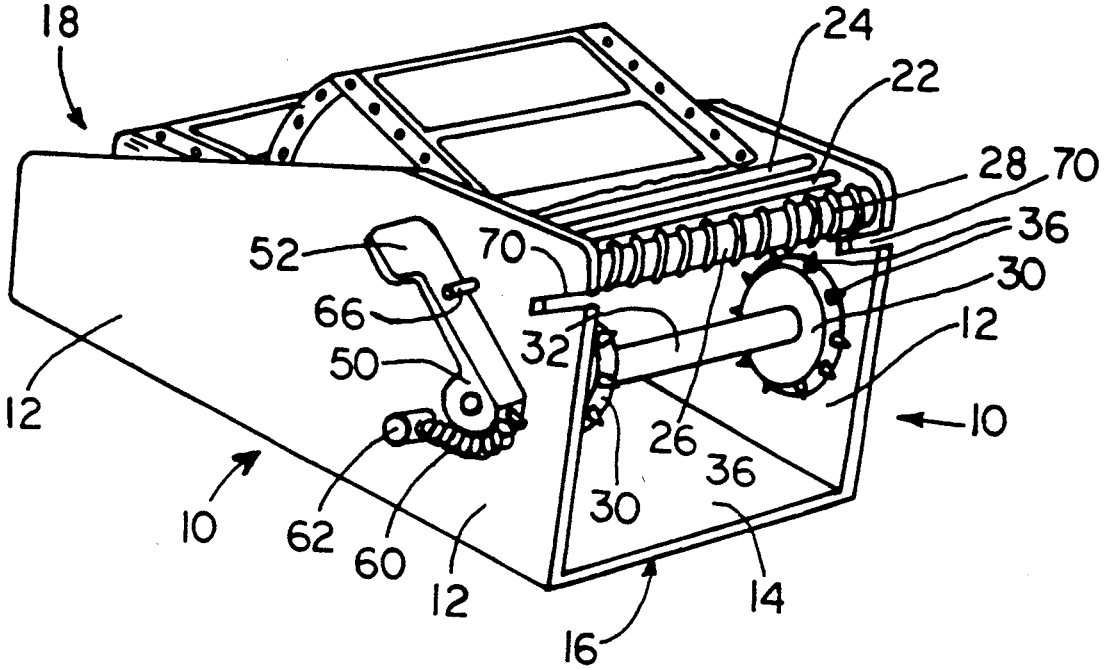
FIG. 1 is a pictorial representation of a label dispenser in accordance with the present invention.

A drive mechanism is provided for pulling the strip of release paper through the dispensing mechanism at the dispensing end 16 of the frame 10. The drive mechanism is positioned below the guide edge 22 and spaced inwardly within the frame 10 from the guide edge 12 or the dispensing end 16 of the frame 10. As illustrated in FIGS. 1–3, the drive mechanism comprises a pair of spaced apart wheels 30 positioned within the frame 10 and adjacent to the inside surfaces of the respective sides 12 of the frame 10. Advantageously, a shaft 32 extends between the sides 12 of the frame 12, and the wheels 30 are mounted on the shaft 32. The shaft 32 is mounted at its opposite ends to the sides 12 of the frame 10 such that the shaft 32 can rotate about its longitudinal axis.

Means are provided for pulling the strip of release paper around the drive wheels 10 as the wheels rotate. As illustrated in FIGS. 1–3, the means for pulling the strip of paper around the drive wheels consists of a plurality of projections 36 that are spaced about the perimeter of the wheels 30. The projections 36 are spaced from each other around the perimeter of the wheels 30 by the same distance that the openings in the sides of the strip of release paper are spaced linearly from each other.

The wheels 30 themselves are spaced from each other such that the projections 36 on the wheels 30 align with the spaced apart openings in the opposite longitudinal sides of the strip of release paper. Strips of release paper having labels temporarily adhered thereto are commonly available in commerce, and the spaced apart openings in the sides thereof are conventionally used to engage projections on wheels used as tractors in computer printers. The wheels 30 and projections 36 of the present invention are very similar or identical to such counterparts used in tractors on computer printers for feeding paper, forms and strips of labels through the printers.

A modified form of a drive mechanism can be employed if strips of release paper are used which do not have the spaced openings along the opposite edges. In such cases, the drive mechanism, as shown in FIG. 4, advantageously comprises a platen roller 40 similar to such rollers used in typewriters. The platen roller 40 is positioned between the opposite sides 12 of the frame 10 and is adapted to rotate about its longitudinal axis. A pinch roller 42 is positioned adjacent to the platen roller 40 to form a nip therebetween. The strip of release paper can then be fed into the nip formed between the pinch roller 42 and the platen roller 40.

Manually operated means are provided for advancing the drive mechanism whether the drive mechanism comprises the wheels 30 or the platen roller 40. As illustrated, the shaft 32 upon which the wheels 30 or the platen roller 40 is mounted extends through one of the sides 12 of the frame 10. A hub 50 engages the projecting end of the shaft 32, and a lever 52 extends from the hub 50. The hub 50 is provided with ratchet like means whereby as the hub 50 is rotated in one direction it engages with and turns the shaft 32 in that direction. As the hub 50 moves in the opposite direction it is disengaged from turning engagement with the shaft 32 and turns free of the shaft 32, that is, the shaft 32 does not turn with the hub 50 when the hub 50 moves in the opposite direction.

Spring biasing means are advantageously provided for returning the lever 52 to its original position after having been manually pressed. As illustrated, a coil spring 60 is attached to a lug on the hub 50, with the coil spring 60 extending beneath the hub 50 to a mounting lug 62 on the side 12 of the frame 10. As the lever 52 is pressed downwardly, the lug on the hub 50 pulls against the coil spring 60. At the end of the appropriate movement of the lever 52, the end point of such movement can be when the lever 52 makes contact with the mounting lug 62, the operator releases the lever 52, and the lever 52 then returns to its original position under the spring biasing force of the coil spring 60.

In the downward movement of the lever 52, the hub 50 causes the shaft 32 to rotate. In the return movement of the lever 52, the hub 50 moves freely without causing any return rotation of the shaft 32. Thus, as the lever 52 is depressed, the rotation of the hub 52 and the shaft 32 causes the drive mechanism to advance and thereby pull a specified length of the strip of release paper past the drive mechanism. The length of the strip of release paper pulled past the drive mechanism is dependent upon the amount of travel of the lever 52 as it is depressed downwardly.

The amount of travel of the lever 52 is set by establishing a stop point in the return travel of the lever 52 when the lever is released. As shown in the drawings, a stop pin 66 extends from the side 12 of the frame 10. The stop pin 66 limits the return travel of the lever 52 and thus establishes the initial position or first position of the lever 52. The mounting lug 62 establishes the second position of the lever 52, and the amount of movement of the lever 52 between the first and second position determines the length of the strip of release paper that is drawn past the drive mechanism.

In operation of the dispenser of the present invention, a supply of labels temporarily adhered to a continuous strip of release paper is provided. The strip of release paper is folded as is well known in the art, and the folded supply of labels forms a rectangular block which is readily received between the opposite sides 12 of the frame 10. The block of labels rests on the floor 14 of the frame 10 at the rear end 18 of the frame 10 behind the dispensing mechanism located at toward the front end 16 of the frame 10.

The upper end of the strip of release paper containing the labels adhered thereto is fed from the top of the block of stored labels over the guide edge 22. A tension rod 24 can be provided extending between the sides 12 of the frame 10. The strip of release paper is fed under the tension rod 24 and then over the guide edge 22. The strip of release paper makes an abrupt turn as it passes over the guide edge and is then directed downwardly and backwardly to the drive mechanism that has been described hereinbefore. The strip of release paper is drawn around the drive mechanism and ejected from the front end 16 of the frame 10 near the bottom side of the front end 16.

The strip of release paper is positioned such that a lead end of a label contained thereon is immediately adjacent to the guide edge 22 when the lever 52 is in its initial or first position. As the lever 52 is manually depressed, the wheels 30 or platen roller 40 of the drive mechanism are turned so as to draw the correct length of the strip of release paper around and past the drive mechanism to draw the same length of the strip of paper over the guide edge 22. As the strip of paper is drawn over the guide edge 22, the label on the paper is peeled therefrom and projected forwardly to fall on the coil spring 28 which is positioned around the rod 26. The peeled label adheres lightly to the coil spring 28 and is ready to be applied to the article on which the label is to be applied. A label identified by the reference number 74 is shown adhered lightly to the coil spring 28 in the drawings.

As illustrated, a pair of elongate slots 70 can be provided in the front edges of the sides 12 of the frame 10. An envelope (not shown in the drawings) can be held in the slots 70, and when the label 74 is deposited on the coil spring 28, the label 74 can quickly and easily be pressed downwardly to transfer the label in proper position onto the envelope. Alternatively, the peeled label 74 can be removed from the coil spring 28 and manually placed on a desired object. The object could also be moved past the dispensing end 16 of the dispenser or vice versa such that the label 74 could be transferred to the article.

Upon return of the lever 52 to its initial position, the dispenser is ready to dispense another label. During each manual operation of the lever 52, a single label is peeled from the strip of release paper and deposited on the coil spring 28. Curved guide plates 78 can be provided if desired to aid in the guidance of the strip of release paper around the drive mechanism and out the bottom portion of the dispenser end 16 of the frame 10.

Although preferred embodiments of the label dispenser of the present invention have been illustrated and described, it is to be understood that the present disclosure is made by way of example and that various other embodiments are possible without departing from the subject matter coming within the scope of the following claims, which subject matter is regarded as the invention.

I claim:

1. A label dispenser for peeling individual adhesive-backed labels from a continuous strip of release paper upon which the labels are stored, said dispenser comprising a frame having opposite sides and a label dispensing end;

a guide edge extending between the opposite sides of said frame and positioned adjacent to a top of the label dispensing end of said frame, such that when a strip of release paper containing an adhesive-backed label thereon passes over the guide edge and makes an abrupt turn as it passes over the guide edge, the label is peeled from said release paper;

a drive mechanism positioned below said guide edge and spaced inwardly within said frame from said guide edge, said drive mechanism having means for pulling said strip of release paper over said guide edge such that the strip of release paper makes an abrupt turn as it passes over said guide edge;

manual means for advancing said drive mechanism to draw a sufficient length of the strip of release paper to said drive mechanism so that a single label is peeled from said strip of release paper as the strip of release paper passes over said guide edge for each individual manual operation of said manual means for advancing said drive mechanism;

a rod extending between the opposite sides of said frame and positioned parallel with said guide edge such that the strip of release paper travels over said guide edge and downwardly between said guide edge and said rod; and an elongate coil spring received over said rod so that the coil spring can freely rotate about said rod.

whereby as said label is peeled from said strip of release paper, said label drops onto said coil spring and is temporarily held on said coil spring by the adhesive back of said label.

2. A label dispenser in accordance with claim 1 wherein said drive mechanism comprises a pair of spaced apart wheels positioned within, said frame, with said wheels having a plurality of radially extending projections equally spaced about the perimeter of said wheels;

said wheels being spaced apart from each other such that the projections on said wheels align with spaced apart openings in opposite longitudinal sides of said strip of release paper; and said projections on each wheel being spaced from each other by the same linear distance along the perimeter of said wheels as the openings in the sides of said strip of release paper are spaced linearly from each other.

3. A label dispenser in accordance with claim 1 wherein said manual means for advancing said drive mechanism comprises a shaft extending from said drive mechanism through a side of said frame;

a hub on the portion of said shaft extending from said frame, with said hub being engageable with said shaft to rotate said shaft as the hub is turned in one direction about the longitudinal a is of said shaft and to disengage from said shaft and freely rotate about said shaft when turned in the opposite direction;

a lever extending from said hub, said lever being movable back and forth between a first position and a second position, wherein as the lever is moved from the first to the second position, the hub rotate said shaft, and when the lever moves from the second portion back to the first position, the hub rotates freely about the shaft without imparting any rotational movement to said shaft; and spring biasing means that biases the lever when the lever is not manually depressed to move said lever to said first position.

* * * * *